United States Patent [19]

Lane

[11] 4,396,245

[45] Aug. 2, 1983

[54] COVER FOR MULTIPLE TERMINAL ELECTRICAL CONNECTOR

[75] Inventor: David Lane, Greensboro, N.C.

[73] Assignee: AMP Incorporated, Harrisburg, Pa.

[21] Appl. No.: 243,154

[22] Filed: Mar. 12, 1981

[51] Int. Cl.[3] ..... H01R 13/60

[52] U.S. Cl. ..... 339/38; 29/758; 29/176 M

[58] Field of Search ..... 339/36, 38, 198 J, 176 M; 29/747, 758

[56] References Cited

U.S. PATENT DOCUMENTS

| | | | |
|---|---|---|---|
| 2,932,811 | 4/1960 | Abraham et al. | 339/38 |
| 3,267,408 | 8/1966 | Baker et al. | 339/38 X |
| 3,389,367 | 6/1968 | Schwartz | 339/38 |
| 3,951,492 | 4/1976 | Braund | 339/176 M X |

FOREIGN PATENT DOCUMENTS

| | | | |
|---|---|---|---|
| 729314 | 3/1966 | Canada | 339/38 |

*Primary Examiner*—Howard N. Goldberg

*Attorney, Agent, or Firm*—Gerald K. Kita; Robert W. J. Usher

[57] ABSTRACT

A cover used to retain terminals in a connector housing prior to application of the housing to a printed board. The over is applied to the face of the connector housing and simulates the shape of a mating connector. Terminals, when assembled in the connector housing at the terminal receiving face abut the cover and are forced into receiving grooves in the housing. Pressure applied to the terminals by the cover retains the terminals within the housing until the housing and terminals are mounted in a printed circuit board. The cover also functions as a dust cover as well as a tool for insertion of the connector into a printed circuit board.

3 Claims, 7 Drawing Figures

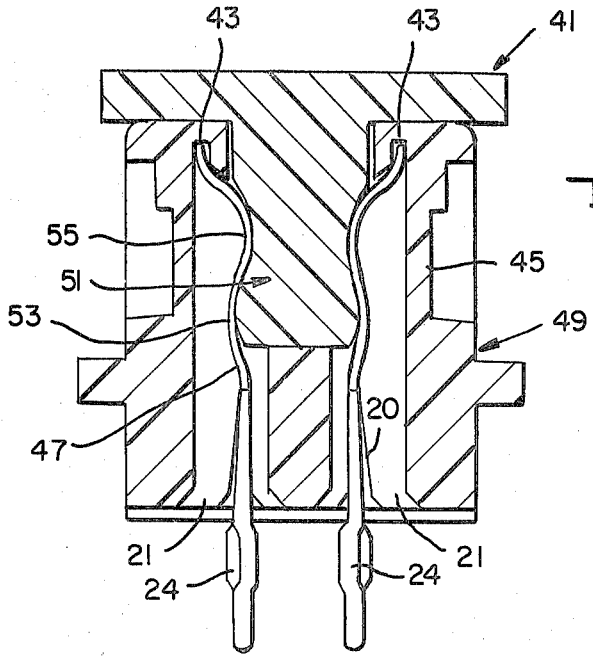
Fig. 7
Fig. 6
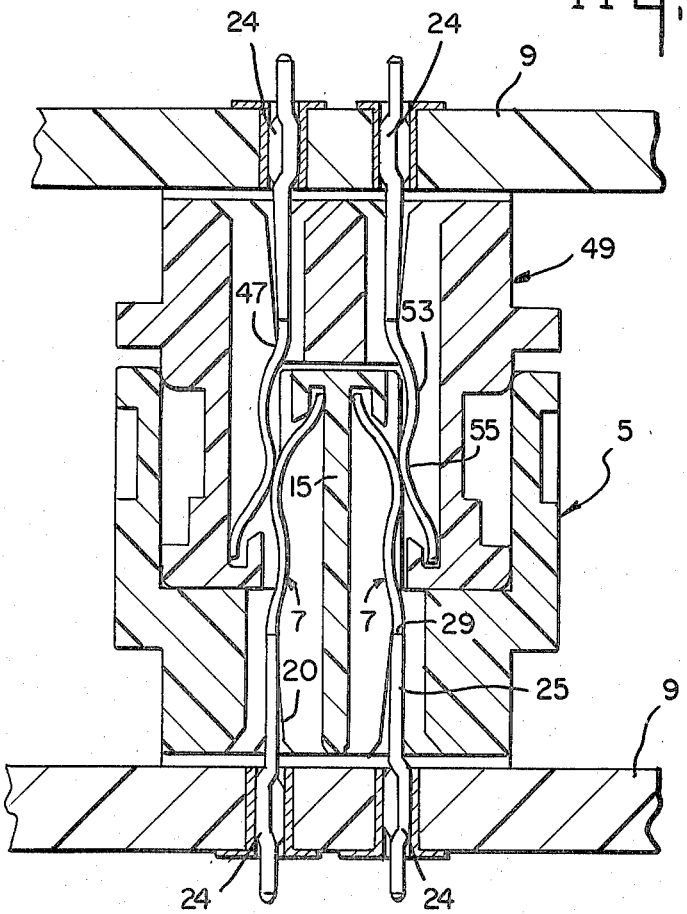

COVER FOR MULTIPLE TERMINAL ELECTRICAL CONNECTOR

BACKGROUND OF THE INVENTION

1. Field of the Invention

This invention relates to a cover for use on an electrical connector and useful particularly prior to and during application of the connector to a printed circuit board.

2. Description of the Prior Art

A widely used prior art electrical connector for assembly in a printed circuit board, requires carrier strip mounted terminals initially inserted into the printed circuit board, with the carrier strip carrying the terminals then being removed. A housing is then inserted over the terminals and secured to the printed circuit board to provide the final connector. It is desirable to provide an electrical connector of the type hereinabove described which can be preassembled and installed as a single unit. The problem with the prior art connector is that it is incapable of preassembly because there is no provision for retaining the terminals themselves within the housing prior to installation.

SUMMARY OF THE INVENTION

In accordance with the present invention, there is provided a cover for a multiple terminal electrical connector for use with printed circuit boards and the like wherein the cover is used to retain terminals in a connector housing prior to application of the housing to a printed board. The cover is applied to the mating face of the connector housing simulating the shape of a mating connector. Terminals are then assembled in the connector housing from the terminal receiving side thereof. The cover forces the terminals into receiving grooves in the housing. The pressure applied to the terminals by the cover retains the terminals within the housing until application of the housing with terminals therein to the printed circuit board. The cover also functions as a dust cover as well as a tool for insertion of the connector into a printed circuit board or the like by bearing against the connector housing when a force is applied to the cover during insertion of the connector into a printed circuit board.

BRIEF DESCRIPTION OF THE DRAWINGS

FIG. 3 is a cross-section taken along the line 3—3 of FIG. 2;

FIG. 5 is a view as in FIG. 3 but with a female type connector and corresponding cover; and FIG. 6 is a cross-sectional view of the connectors of FIGS. 3 and 5 in mated relation.

DESCRIPTION OF THE PREFERRED EMBODIMENTS

Figure 1:
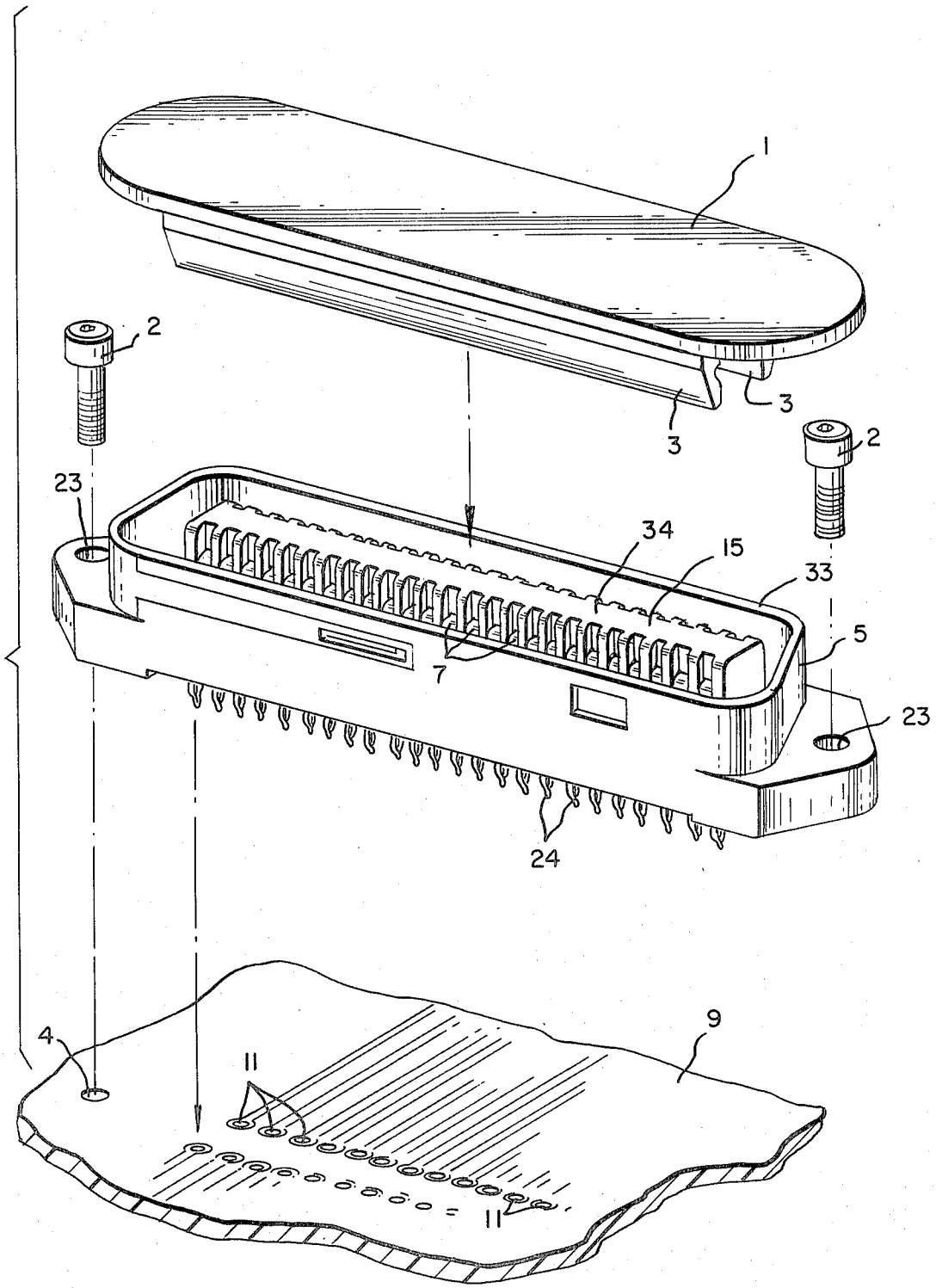
FIG. 1 is an exploded view of a male type electrical connector with cover in accordance with the present invention as applied to a printed circuit board.

Referring first to FIG. 1, there is shown an exploded view of an electrical connector assembly including a cover 1 having depending ribs 3 and a housing 5 having terminals 7 therein. The terminals 7 would be readily pushed out of the housing 5 without the cover 1 being positioned in the housing as described hereinbelow. The cover 1 is secured in the housing 5, and the housing 5 with terminals 7 and cover 1 therein is secured, assembled and mounted in a printed circuit board 9 by terminals 7 entering the holes 11 which are aligned therewith and the housing 5 being secured to the printed circuit board 9 by means of bolts 2 passing through apertures 23 in the housing and appropriate apertures 4 in the printed circuit board. The assembly of the cover 1, housing 5 and terminals 7 is shown in FIG. 2.

Figure 2:
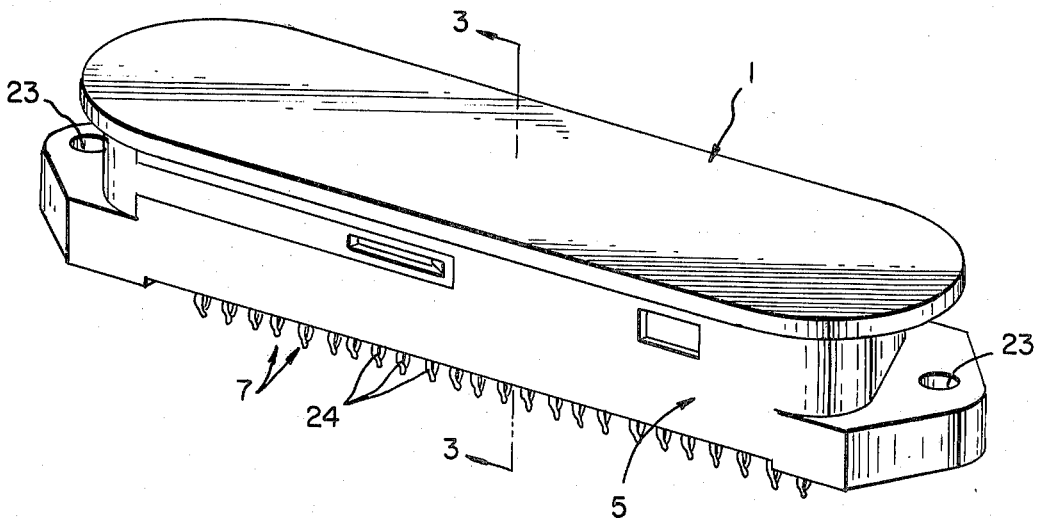
FIG. 2 is a view as in FIG. 1 with the parts of the electrical connector assembled.
Figure 7:
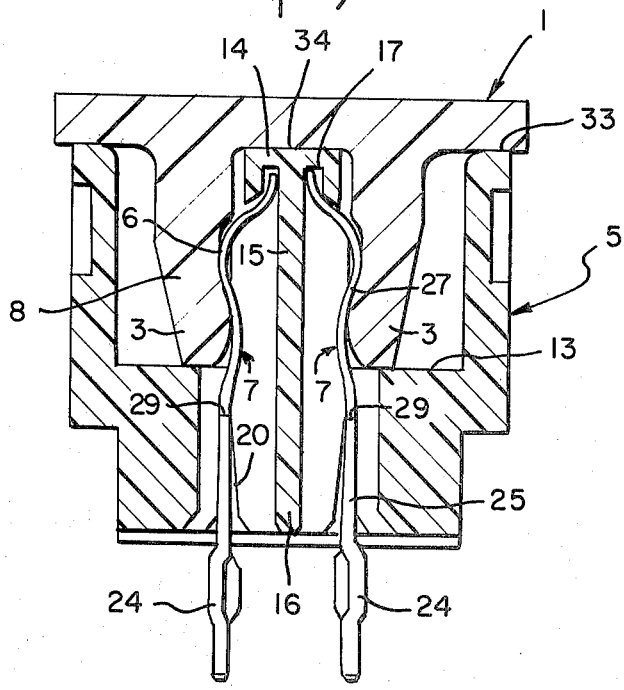

Referring now to FIG. 3, there is shown a cross-sectional view of the connector assembly of FIG. 2. The cover is positioned within the housing 5 with the depending ribs 3 positioned against the inner wall seat 13 of the housing and with the top portion of the cover abutting the connector receiving face surface 33 of the housing 5. The cover also impinges against the end surface 34 of a center, male type plug portion 15 of the housing 5. The portion 15 includes inverted grooves 17 in the horizontal portions 14 into which the ends of the terminals 7 are positioned. The terminals 7 are resilient spring members and are forced toward the center wall portion 16 of the portion 15 by the depending ribs 3 which simulate a mating connector and apply forces against the terminals 7 to retain the terminals within the housing 5.

Figure 4:
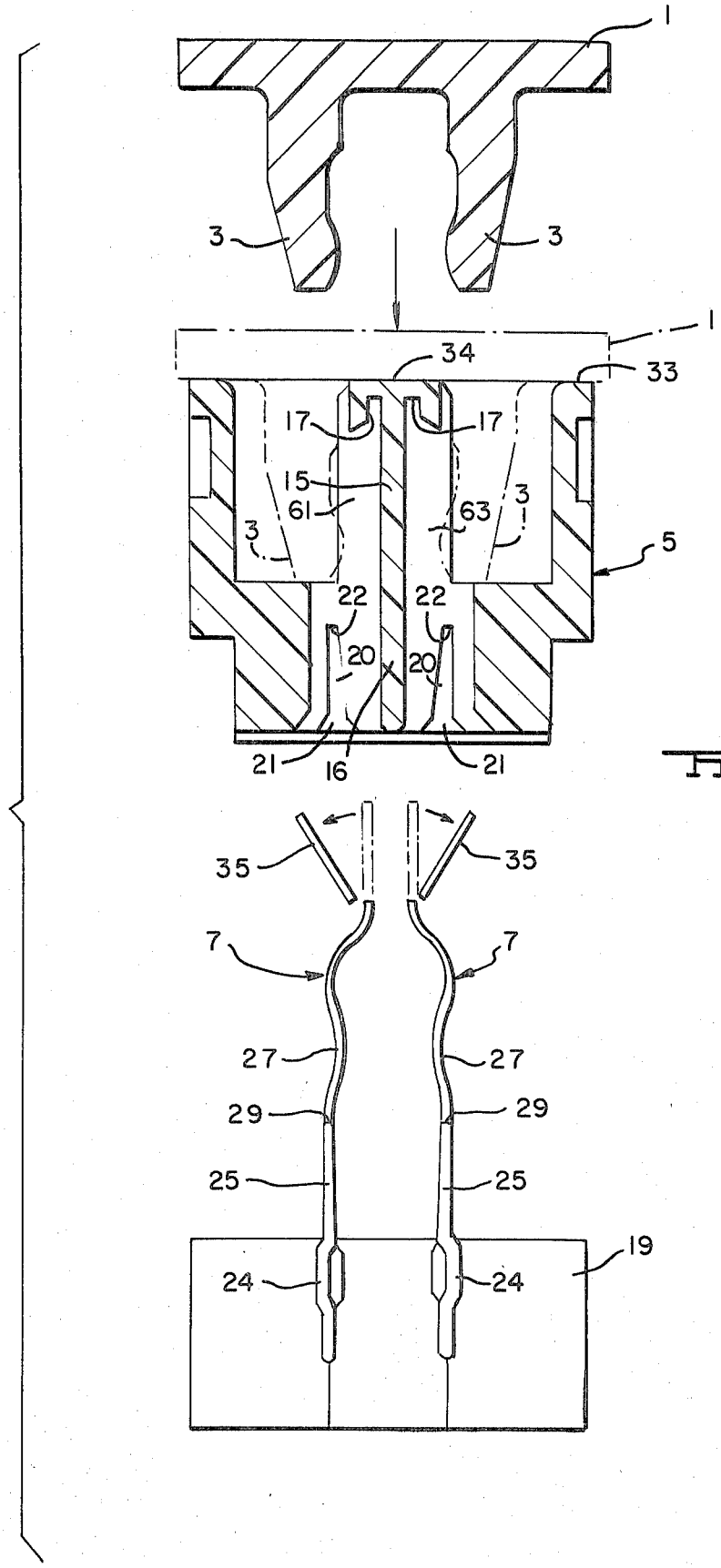
FIG. 4 is an exploded view showing the assembly tooling of the electrical connector and cover in accordance with the present invention.
Figure 4A:
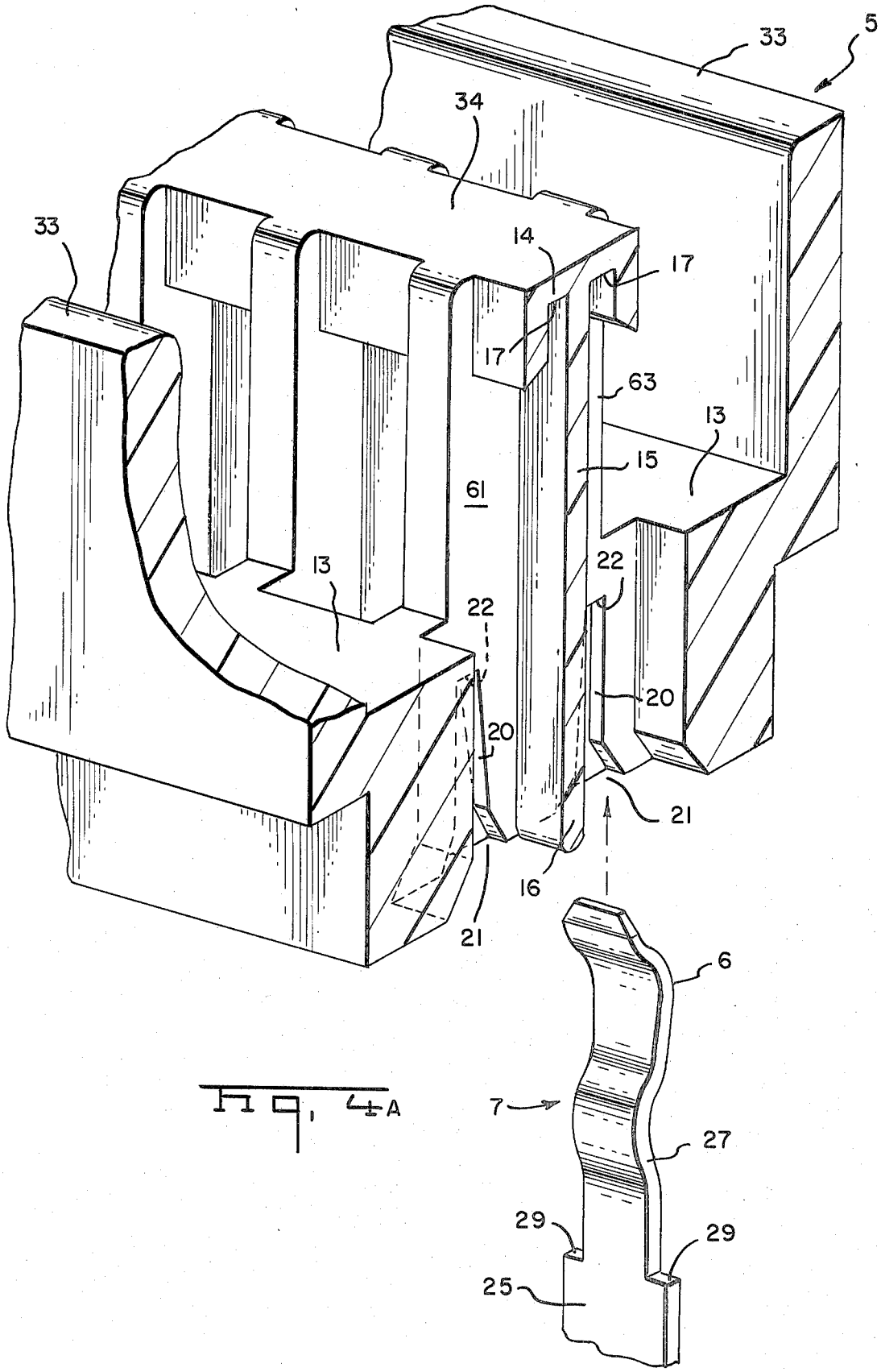
FIG. 4A is a side elevation of a portion of the tool shown in FIG. 4.

Referring now to FIGS. 4 and 4A, there is shown an exploded view of the connector assembly. It can be seen that the terminals 7 are connected together in strips by means of carrier strips 35. The terminals with carrier strips are inserted into apertures 24 in an insertion tool 19 and the carrier strips are then removed. The cover 1 is inserted into the housing 5, the cover being shown in phantom after insertion into the housing 5, in FIG. 4 and the insertion tool with two rows of terminals 7 thereon and carrier strips 35 removed is then moved toward the housing 5 whereby the terminals 7 enter the housing through the openings 21 in the terminal receiving end 34 of the housing. It can be seen that each of the terminals 7 has a narrow portion 27 and a wide portion 25 with the junction of these portions being shown as shoulders 29. The openings 21 are designed as shown in FIG. 4 so that, as the terminals 7 enter into the housing, they are forced inwardly by the depending ribs 3 of the cover whereby the top ends of the narrow portion 27 will enter the grooves or notches 17 as shown in FIG. 3 and abut the portion 16. As can be seen from FIG. 4A, the terminal 7 is disposed between a pair of wall surfaces 61 and 63 which extend between the opening 21 at the terminal receiving end 34 and the mating end 36 with notches 17 formed between said wall surfaces 61 and 63. The width of the portion 27 of the terminal 7 is less than the distance between wall surfaces 61 and 63 whereas the width of the portion 25 is greater than the distance between wall surfaces 61 and 63. Therefore, when the junction 29 reaches the top 22 of groove 20 in the opening 21, the opening 21 will become so restricted that the terminal 7 can no longer move upwardly into the housing. The shoulder 25 will abut the top 22 of groove 20 and further movement of terminal 7 into housing 5 will then cease. The terminals will then be secured in the housing 5 in the manner shown in FIG. 3.

It can be seen in FIGS. 3 and 4 that the depending ribs 3 act to retain the terminals 7 within the housing by means of legs 8 of cover 1 supporting the outwardly bowed portion 6 of terminal 7 within the housing and forcing the terminals against the portion 15 within the grooves or notches 17 so that the entire unit as shown in FIG. 2 can be shipped to an ultimate user.

Referring now to FIG. 5 there is shown a female version connector designed to mate with the connector of FIGS. 1–4. The mated connectors are shown in FIG. 6. As can be seen in FIG. 5, the cover 41 has a T-shape cross-section and the terminals 47 are the same as terminals 7 of FIGS. 1 thru 4 except that they have been rotated 180° about their axes. In addition, the portion 15 with grooves 17 has been replaced by a set of grooves 43 in the side walls 45 of the housing 49. More specifically, the cover 41 is positioned in the housing 49 at the mating end 65 thereof to simulate a mating connector. The terminals 47 project out of the housing 49 at the terminal receiving end 67 thereof and are secured in the grooves 43 in the side walls 45 under a force from cover 41.

The connector of FIG. 5 will be assembled in the same manner as described with respect to the connector of FIG. 4 except that the strips of terminals 7 are rotated 180° in the insertion tool 19 prior to insertion of the terminals into the housing 49. Upon insertion of the terminals into the housing 49, the depending portion 51 of the cover 41 with enlarged portion 53 will engage and move the terminals 45 outwardly so that the upper portion thereof will move into the notches 43 and against the wall 45 as shown in FIG. 5. It can be seen that the enlarged portion 53 of cover 41 supports the inwardly bowed portion 55 of terminal 47. The connector can then be assembled onto a printed circuit board as a single element in the manner described above with regard to the embodiment of FIGS. 1 thru 4. The cover 41 can then be removed for connection with a mating connector as shown in FIG. 6.

Referring now to FIG. 6 there is shown a pair of mated terminals of the type shown in FIGS. 3 and 5. It can be seen that in each case, the mating connector has taken the place of the cover to retain the terminals within the housing until actual application of the connector to a printed circuit board and the like. The connectors of FIG. 6 can each be applied to a different circuit board with interconnection between circuit boards taking place by mating of the connectors as shown in FIG. 6. The individual connectors as shown in FIG. 6 would normally not be shipped as a mated pair and would appear as shown in interconnection between two printed circuit boards, a printed circuit board and a multi-line cable or the like.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

I claim:

1. An electrical connector assembly comprising a connector housing having a mating face and a second, terminal-receiving face, at least one row of terminal-receiving grooves located spaced apart along the housing interior, each groove extending from the second face toward the mating face, elongate electrical terminals inserted longitudinally in respective grooves, the terminals having longitudinal post portions projecting outwardly of the second face for wedge mounting the terminals within apertures of a printed circuit board, characterized in that;

a cover is removably assembled on the housing and has a rib facing each row of terminals, the rib extending into the housing interior to guide the terminals along and retain the terminals in the grooves as the terminals are moved along their paths of insertion to enter the housing from the second face, the cover impinging the mating face so as to retain the terminals in the grooves as a force is applied along the cover to move the terminals into the apertures of a printed circuit board.

2. The electrical connector assembly according to claim 1 in which the grooves have portions of restricted width extending to wide openings adjacent the second face, and the terminals have shoulders impinging walls of the wide openings adjacent the portions of restricted width to restrict movement of the terminals along the grooves toward the mating face.

3. The electrical connector assembly recited in claim 1 in which the terminal has bowed, resilient contact portions and the rib conforms to the bowed portions of the terminals and exerts retention forces against the bowed portions while a force is exerted against the cover to move the terminals into apertures of a printed circuit board.

* * * * *